US006439405B1

(12) United States Patent
Hanneken

(10) Patent No.: US 6,439,405 B1
(45) Date of Patent: Aug. 27, 2002

(54) CEILING-SUSPENDED STORAGE SYSTEM

(75) Inventor: John B. Hanneken, 1251 E. Laguna Dr., Tempe, AZ (US) 85282

(73) Assignee: John B. Hanneken, Tempe, AZ (US)

( * ) Notice: Subject to any disclaimer, the term of this patent is extended or adjusted under 35 U.S.C. 154(b) by 0 days.

(21) Appl. No.: 09/726,988

(22) Filed: Nov. 30, 2000

(51) Int. Cl.[7] ..... A47F 5/08
(52) U.S. Cl. ..... 211/113; 211/118; 248/215
(58) Field of Search ..... 211/113, 118, 211/117, 60.1; 248/214, 215, 301, 340, 343, 317

(56) References Cited

U.S. PATENT DOCUMENTS 904,355 A * 11/1908 O'Connor ..... 211/113
2,643,777 A * 6/1953 Pickens, Jr. ..... 211/113
3,945,462 A * 3/1976 Griswold ..... 248/241
3,978,988 A * 9/1976 Friedeberg ..... 211/113
4,061,092 A 12/1977 Jacobsen et al.
4,129,080 A 12/1978 Vall
4,162,730 A * 7/1979 Steere, Jr. et al. ..... 211/118
4,893,715 A * 1/1990 Papazian et al. ..... 211/118
4,944,434 A * 7/1990 Hamilton ..... 211/119
4,949,924 A * 8/1990 Carmody ..... 248/215
5,348,166 A * 9/1994 Lema ..... 211/113
5,615,783 A * 4/1997 Warnken ..... 211/118
5,695,079 A * 12/1997 Peay ..... 211/118
5,738,319 A * 4/1998 Grassi ..... 248/215
5,810,304 A * 9/1998 Lehrman ..... 248/215
5,836,486 A * 11/1998 Ohsugi ..... 211/113
5,996,506 A * 12/1999 Woytovich ..... 211/113
6,059,122 A 5/2000 Cartmell
6,073,624 A 6/2000 Laurent
6,116,164 A * 9/2000 Justen, Jr. ..... 211/113
6,145,678 A * 11/2000 Morrison ..... 211/113
6,155,440 A * 12/2000 Arce ..... 211/118
6,158,704 A * 12/2000 O'Neill ..... 248/317

* cited by examiner

*Primary Examiner*—Daniel P. Stodola
*Assistant Examiner*—Jennifer E. Novosad
(74) *Attorney, Agent, or Firm*—Bradley J. Botsch

(57) ABSTRACT

A fully ceiling-suspended system and apparatus for storing different shapes/types of elongated objects. The system includes a minimum of only two separate brackets that are ceiling-mounted to form a storage apparatus that is capable of supporting elongated items of different lengths provided that the length of each item to be stored is at least the length of the distance that the two ceiling-suspended brackets are separated. Further, each of the brackets may include different pockets of storage space that may be used for holding/storing elongated items of different shapes or cross-sectional configurations.

13 Claims, 8 Drawing Sheets

CEILING-SUSPENDED STORAGE SYSTEM

BACKGROUND OF THE INVENTION

This invention relates to storage systems and, in particular, to a fully ceiling-suspended system and apparatus for storing elongated objects of different sizes and shapes.

The storage of items is something that every homeowner and business owner is concerned about. The square footage of a home or business is always a limiting constraint on the amount of storage space that one may utilize. Further, most owners utilize some type of wall-mounted or free-standing storage system to store various items whereby these types of storage systems take away from valuable living/working space of a room.

There exists a plurality of storage systems. For example, referring to U.S. Pat. No. 4,061,092 to Jacobsen, et al., a shelf platform which may be suspended from a support beam or ceiling is disclosed. In particular, the '092 patent teaches the use of separate shelves that are vertically interconnected by a chain to form the overall shelf platform.

Further, U.S. Pat. No. 4,129,080 to Vall discloses a shelf support device that may be wall hung, ceiling hung or free standing. In particular, the device utilizes a shelf sling means which, when hung, converts the outward moment of each loaded shelf down the surface of the wall directly beneath and at right angles to the point at which the device is anchored into the wall.

None of the above mentioned art teach a ceiling-suspended storage system that comprises a minimum of only two support brackets for storing elongated items of different size, shape and length. Further, none teach that efficiently utilizing the space just below the ceiling of a room or garage for the storage of items may be a way of substantially improving the storage capability of an area while not decreasing the effective usable living/working space. Hence, what is needed is an improved system and apparatus that is fully ceiling-suspended and having a plurality of different pockets that are capable of storing elongated items of different shapes and lengths.

DETAILED DESCRIPTION OF THE DRAWINGS

The present invention relates to a fully ceiling-suspended system and apparatus for storing different shapes of elongated objects. The system includes a minimum of only two separate brackets that are ceiling-mounted to form a storage apparatus that is capable of supporting elongated items of different sizes and shapes provided that the length of each item to be stored is at least the distance between the two ceiling-suspended brackets. Further, each of the brackets may include different pockets of space that may be used for holding/storing elongated items of different shapes or cross-sectional configurations. Additionally, although only a minimum of two ceiling-suspended brackets are necessary, the present invention may include more ceiling-mounted brackets for storing elongated items of varying length based on the distance between any two of the brackets.

Figure 1:
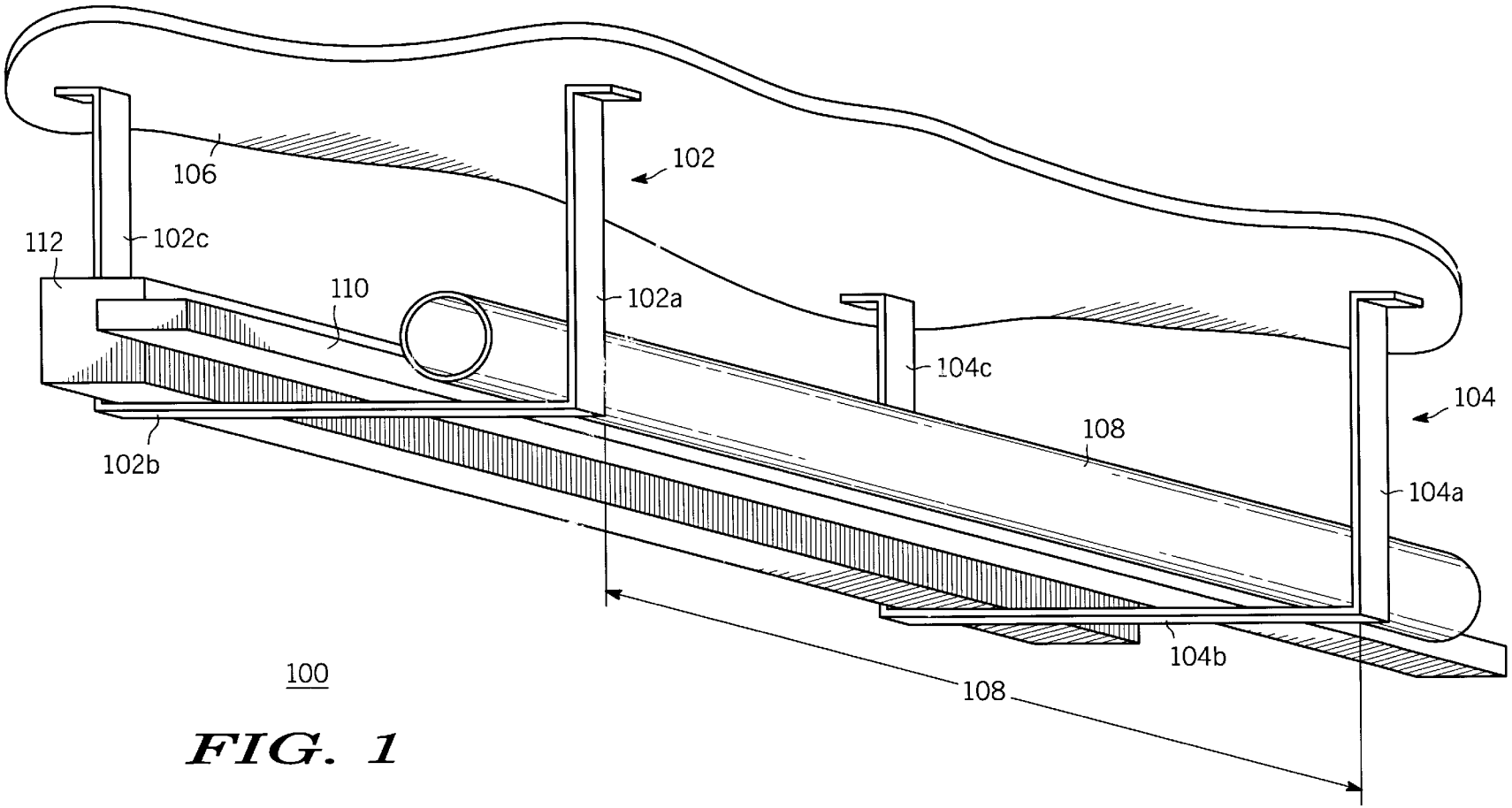
FIG. 1 is an isometric view of a first embodiment of a ceiling-suspended storage system in accordance with the present invention.
Figure 2:
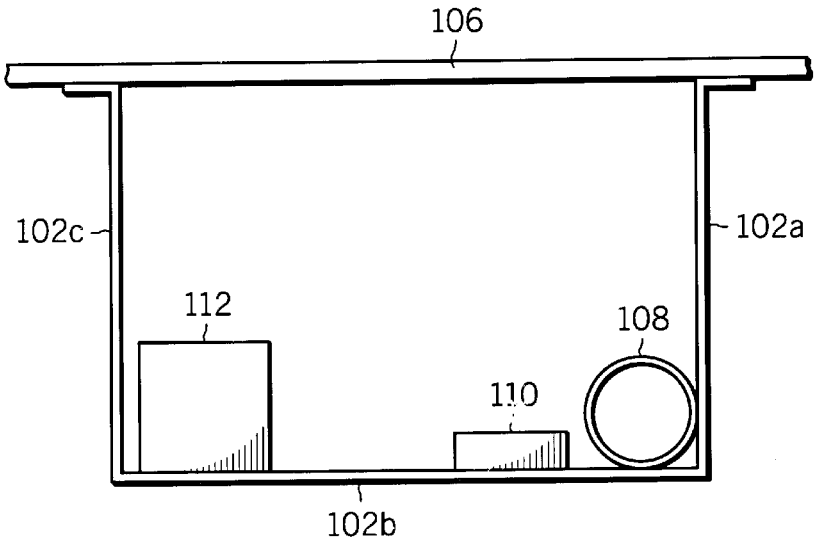
FIG. 2 is a side view of the ceiling-suspended storage system of FIG. 1.

Referring to FIGS. 1 and 2, isometric and side views, respectively, of a first embodiment of a ceiling-suspended storage system are shown. Storage system 100 of FIGS. 1 and 2 includes first and second brackets 102 and 104 that are both suspended to ceiling 106. Further, bracket 102 includes segments 102*a*, 102*b* and 102*c* whereby segments 102*a* and 102*c* are vertical segments that are substantially perpendicular to ceiling 106 and whereby segment 102*b* is a horizontal segment that is substantially parallel to ceiling 106. Accordingly, bracket 102 forms a U-shaped bracket configuration. In particular, segment 102*a* has a first end coupled to ceiling 106 and a second end coupled to a first end of segment 102*b*. Segment 102*b* additionally has a second end coupled to a first end of segment 102*c*. Finally, segment 102*c* is coupled to ceiling 106. It is understood that brackets 102 and 104 may be directly coupled to ceiling 106 by means of any suitable connector, such as screws or ails, or may be coupled to an intermediate component such as a block of wood that is then coupled directly to ceiling 106. As can be seen from FIG. 1, brackets 102 and 104 are separated by distance 108, wherein distance 108 may be any selected distance for storing elongated items having a length of at least the distance 108. Further, brackets 102 and 104 are aligned with respect to each other in a manner such that segments 102*b* and 104*b* are substantially parallel with each other.

As can be seen from FIGS. 1 and 2, the U-shaped brackets 102 and 104 of storage system 100 are capable of storing elongated objects of different shapes such a circular-shaped object 108, rectangular-shaped object 110 and square-shaped object 112. Further, storage system 100 is capable of storing elongated objects having at least a length of the distance that ceiling-suspended brackets 102 and 104 are separated. Accordingly, storage system 100 provides a simple, cost effective and efficient system for storing elongated objects just below the ceiling thereby utilizing space that is typically not usable in a room/garage.

Figure 2A:
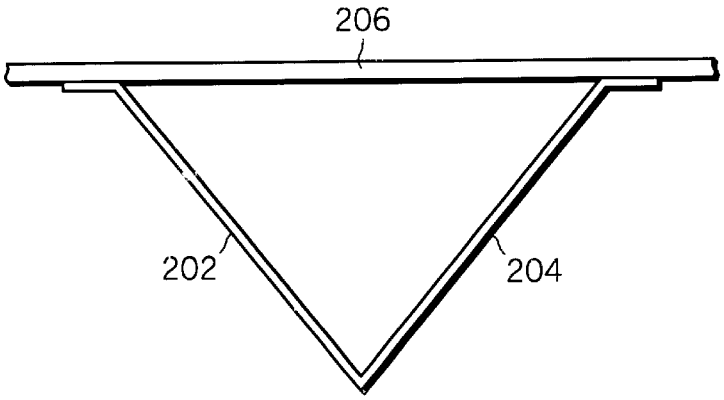
FIGS. 2A and 2B are side views of alternate bracket configurations for the ceiling-suspended storage system of FIG. 1.
Figure 2B:
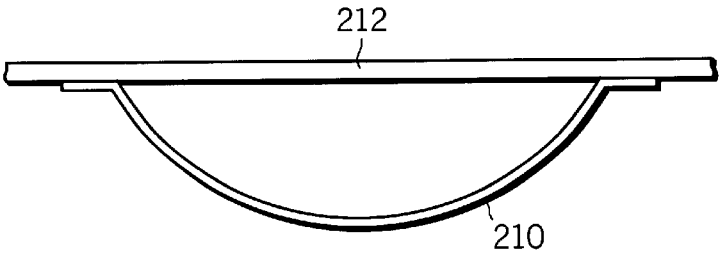

Although brackets 102 and 104 are shown as forming a U-shaped configuration, such brackets may be any suitable form, such as circular, elliptical or triangular, for storing elongated items of various shapes. Referring to FIGS. 2A and 2B, side views of alternate bracket configurations for the ceiling-suspended storage system of FIGS. 1 and 2 are shown. In particular, FIG. 2A illustrates a side view of a triangular/V-shaped bracket comprising segments 202 and 204 whereby each of the segments has a first end coupled to ceiling 206 and a second end coupled to the second end of the other thereby forming a V-shaped configuration. Further, FIG. 2B illustrates a side view of a circular/elliptical bracket comprising non-linear segment 210 having first and second ends coupled to ceiling 212 whereby segment 210 is conformed to a non-linear shape, such as a circular shape or an elliptical shape, for storing elongated items of various shapes.

Figure 2C:
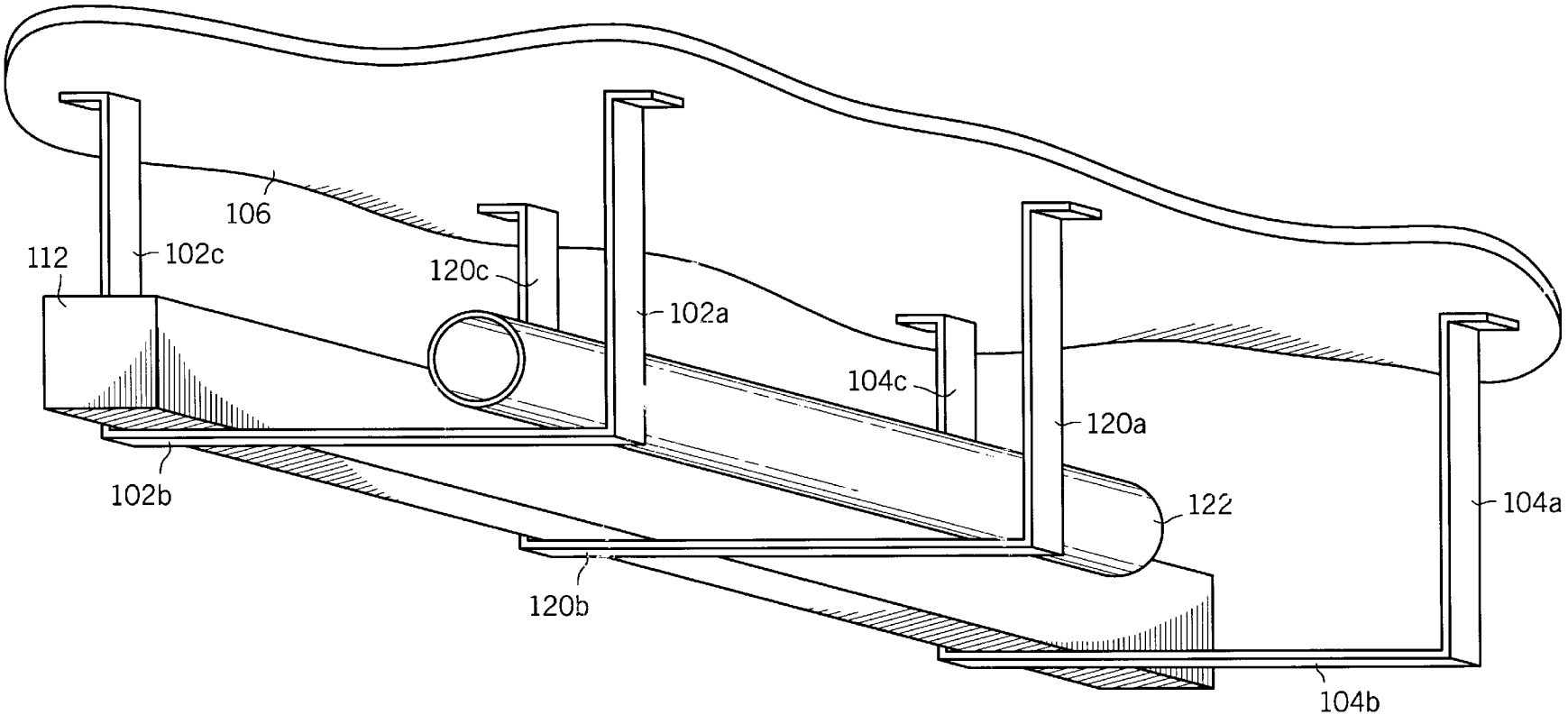
FIG. 2C is an isometric view illustrating an additional bracket added to the first embodiment of the ceiling-suspended storage of FIG. 1.

Further, although storage system 100 requires only two brackets, it is understood that one or more additional brackets may be employed in order to increase the amount of load that may be supported by the overall system and/or in order to enable storage system 100 to be able to store elongated objects whose length is less than that of the distance between brackets 102 and 104. Accordingly, referring to FIG. 2C, a third bracket 120 may be longitudinally positioned anywhere between brackets 102 and 104 to provide the capability to store elongated objects whose length is at least the distance separated by any two of brackets 102, 104 and 120. For example, elongated object 122 is shown as being supported between brackets 102 and 120 whereby the length of object 122 is less than the distance between brackets 102 and 104 but at least the distance between brackets 102 and 120. Further, it is understood that the distance between brackets 102 and 104 and brackets 120 and 104 may be the same or different thereby accommodating the storage of elongated objects of a plurality of lengths.

The next several embodiments that will be discussed are based on the above-described embodiments of FIGS. 1 and 2 but include additional segments/components for forming different types of storage pockets that may be more suitable for storing different shapes/sizes of certain elongated items. Further, these next several embodiments apply to all bracket configurations (U-shaped, V-shaped and circular-shaped).

Figure 3:
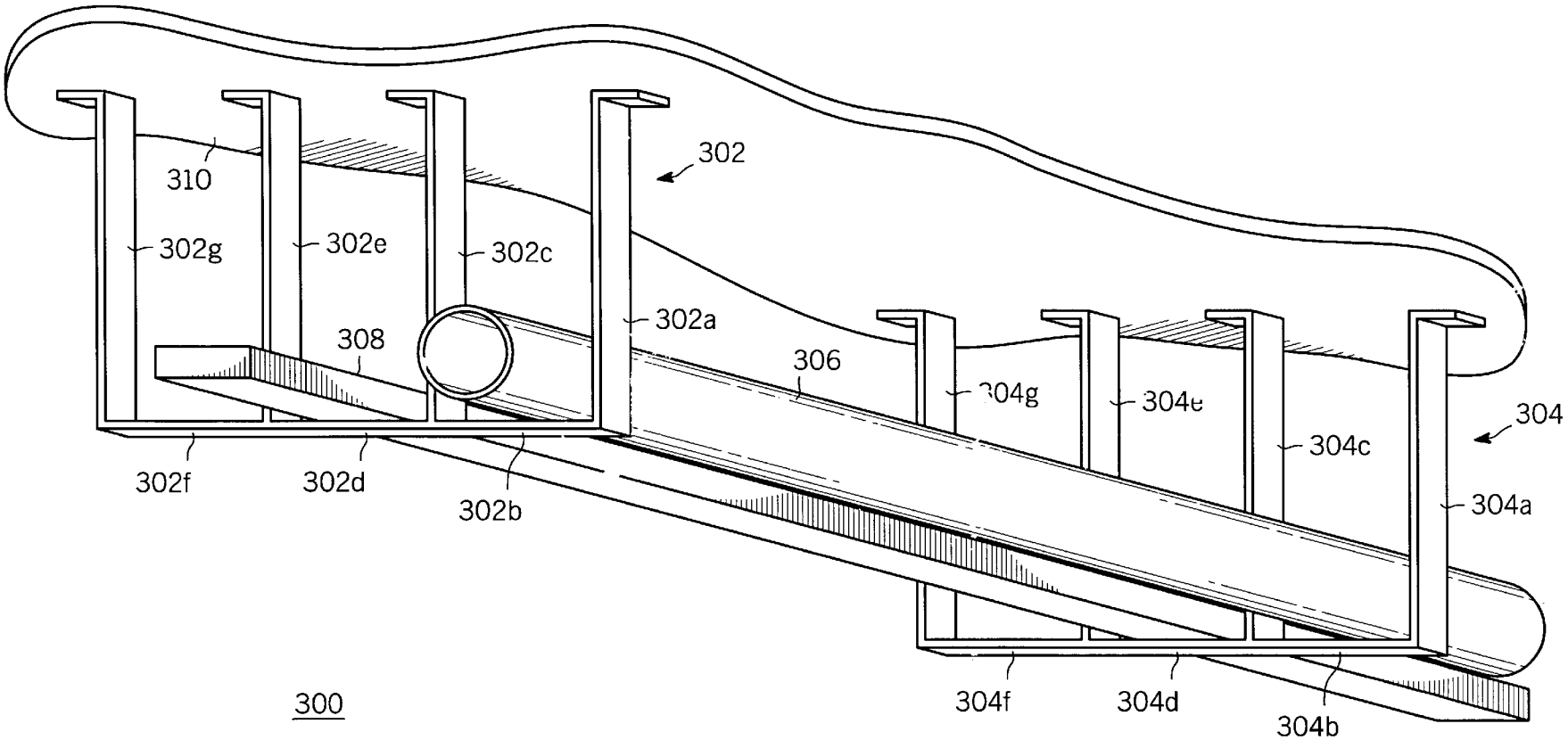
FIG. 3 is an isometric view of a second embodiment of a ceiling-suspended storage system in accordance with the present invention.
Figure 4:
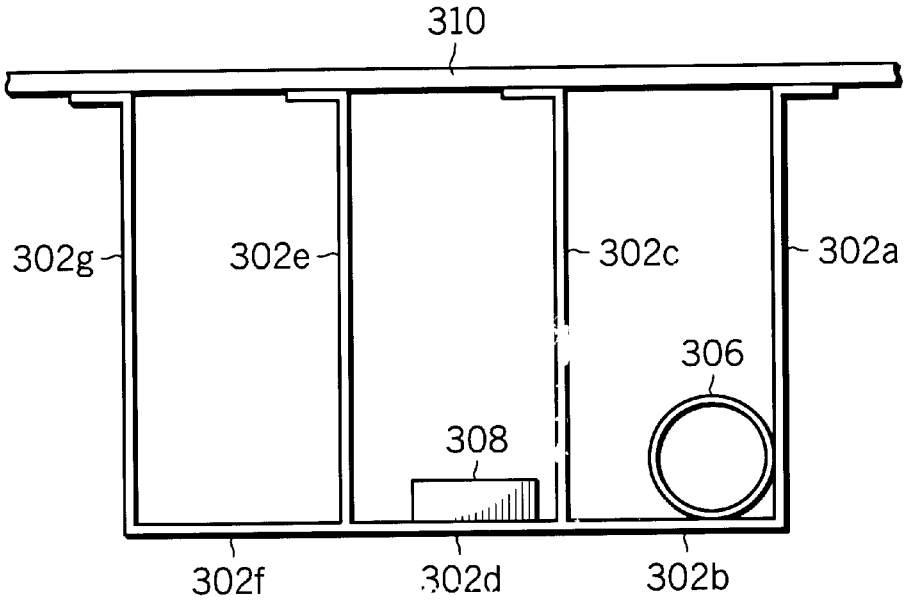
FIG. 4 is a side view of the ceiling-suspended storage system of FIG.3.

Referring now to FIGS. 3 and 4, isometric and side views, respectively, of a second embodiment of a ceiling-suspended storage system are shown. Storage system 300 of FIGS. 3 and 4 includes first and second brackets 302 and 304 that are both suspended to ceiling 310. Bracket 302 is similar to bracket 102 of FIG. 1 in that it includes a U-shaped bracket. However, bracket 302 additionally includes one or more vertical segments (302*c* and 302*e*) for further partitioning the usable storage space of storage system 300. Accordingly, bracket 302 includes segments 302*a–g* for forming a U-shaped configuration with one or more vertical partitions. In particular, segment 302*a* has a first end coupled to ceiling 310 and a second end coupled to a first end of segment 302*b*. Segment 302*b* additionally has a second end coupled to first ends of segment 302*c* and segment 302*d*. The second end of segment 302*c* is coupled to ceiling 310. The second end of segment 302*d* is coupled to the first ends of segments 302*e* and 302*f*. The second end of segment 302*e* is coupled to ceiling 310. The second end of segment 302*f* is coupled to the first end of segment 302*g*. The second end of segment 302*g* is coupled to ceiling 310. It is understood that segments 302*b*, 302*d* and 302*f* may comprise one continuous piece of material or may be segments as described above. With the incorporation of vertical segments 302*c* and 302*e* , storage system 300 is capable of compartmentalizing various elongated items to be stored. For example, round PVC pipe may be stored in one compartment while rectangular pieces of wood may be stored in another.

Figure 6:
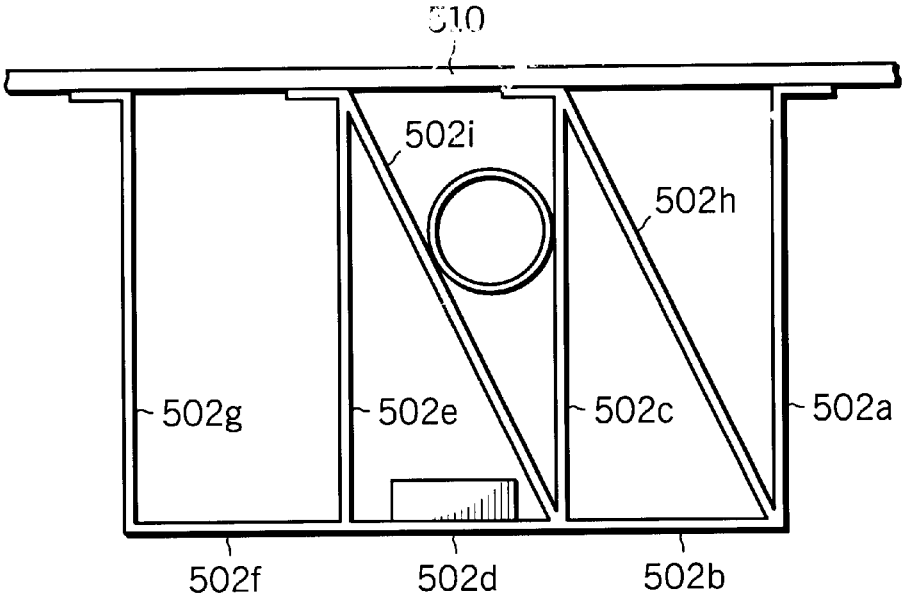
FIG. 6 is a side view of the ceiling-suspended storage system of FIG. 5.
Figure 5:
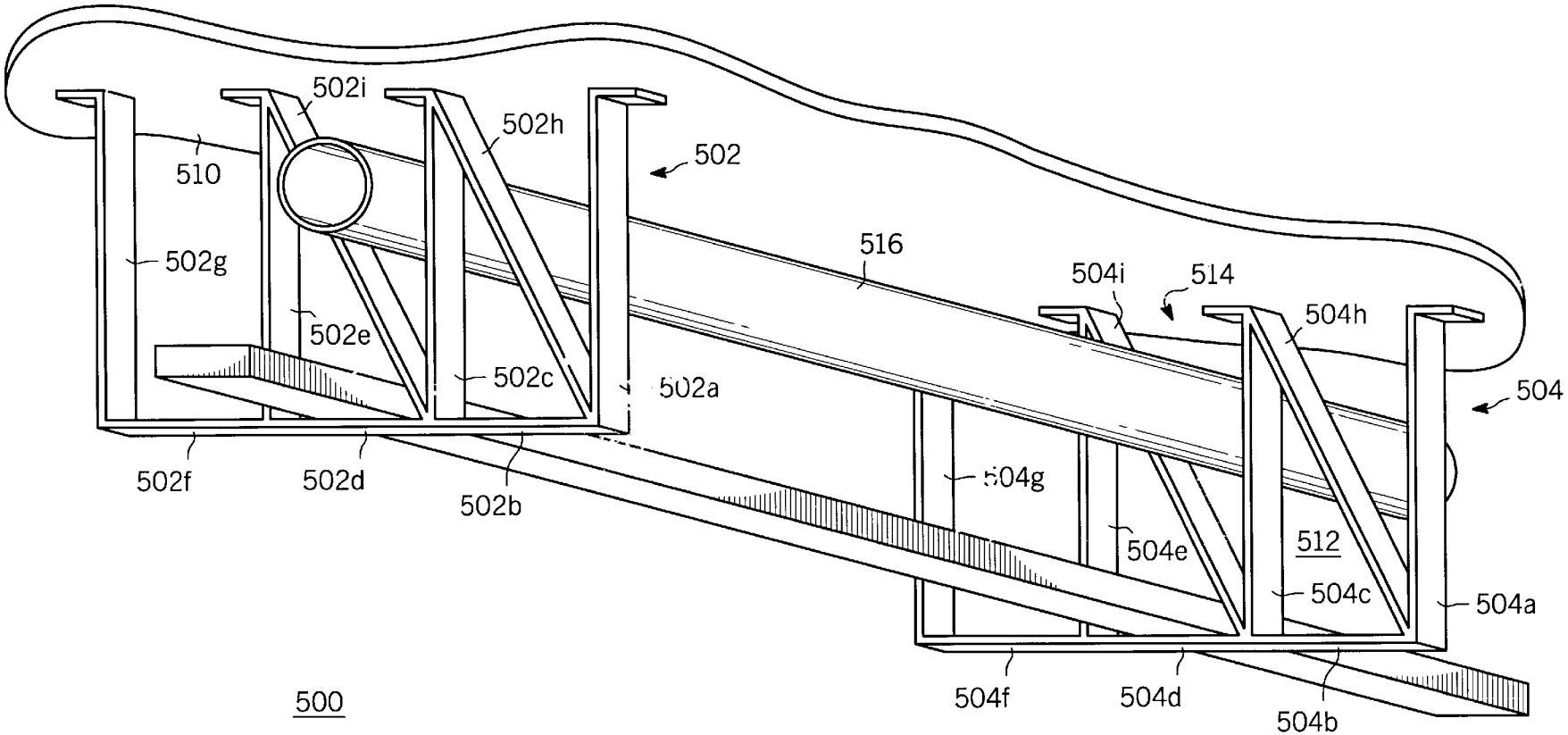
FIG. 5 is an isometric view of a third embodiment of a ceiling-suspended storage system in accordance with the present invention

Referring to FIGS. 5 and 6, isometric and side views, respectively, of a third embodiment of a ceiling-suspended storage system are shown. Storage system 500 of FIGS. 5 and 6 includes first and second brackets 502 and 504 that are both suspended to ceiling 5 10. Bracket 502 is substantially similar to bracket 302 of FIG. 3 and additionally includes cross member segments 502*i* and 502*h* for further partitioning the usable storage space of storage system 500. For purposes of this invention, a cross member segment is a segment that of not substantially parallel or substantially perpendicular to ceiling 510. In particular, segment 502*i* has a first end coupled to ceiling 510 and a second end coupled to a first end of segment 502*c*. Segment 502*h* has a first end coupled to ceiling 510 and a second end coupled to the first end of segment 502*b*. With the inclusion of cross member segments 502*h –i*, storage system 500 includes even more compartmentalized storage areas 512 and 514. Further, storage areas such as area 514 is much better suited to store elongated items having a circular cross section, such as elongated item 516, because circular items will not roll when nested between segments 504*c* and 504*i*. Note also that the V-shaped bracket shown in FIG. 2A is also suitable for storing such circular cross-sectional items for the same reason.

Figure 7:
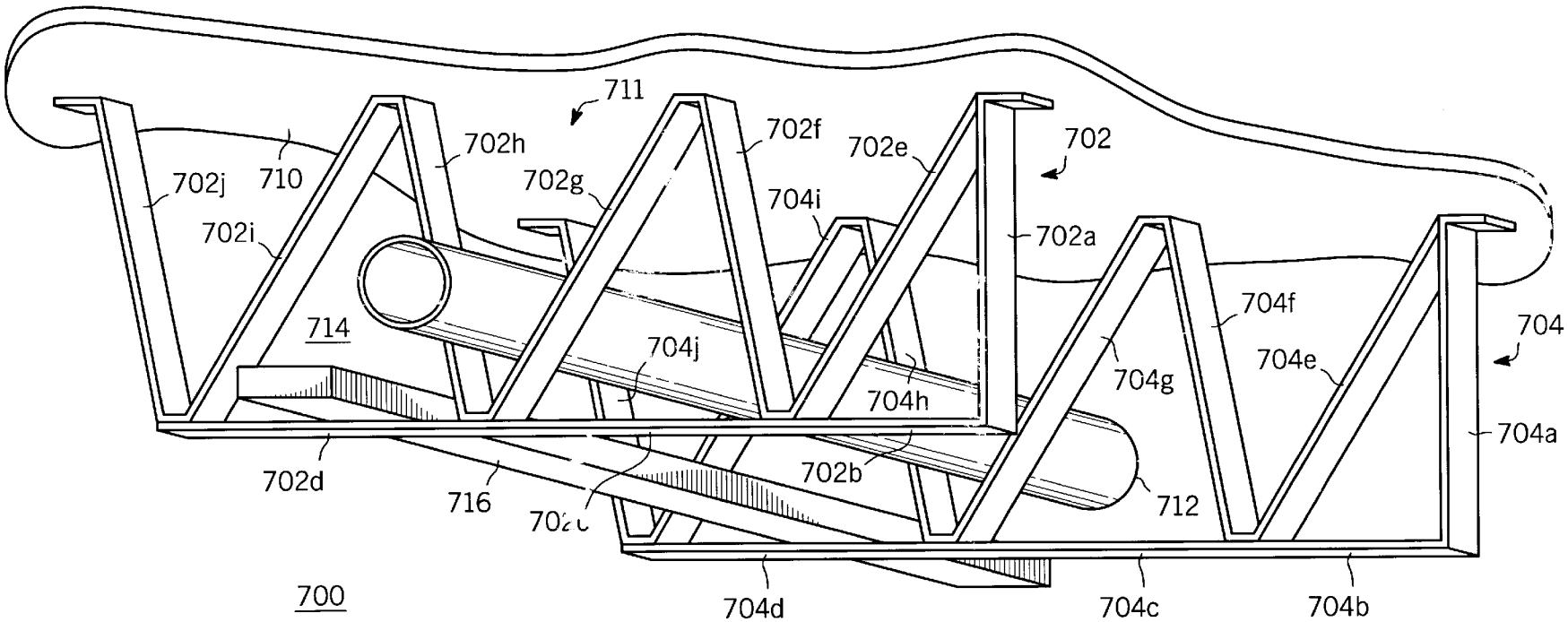
FIG. 7 is an isometric view of a fourth embodiment of a ceiling-suspended storage system in accordance with the present invention.
Figure 8:
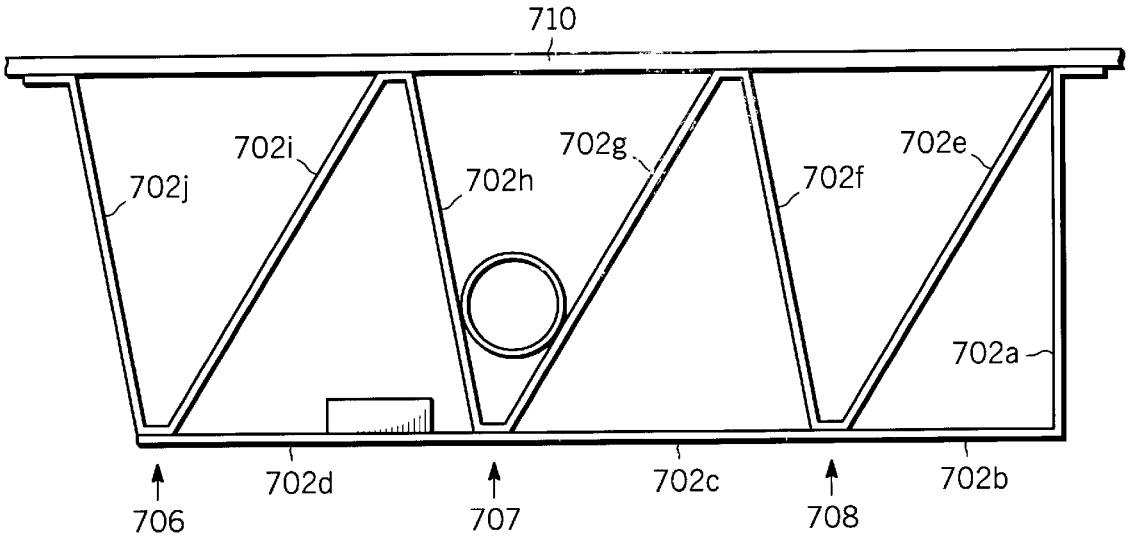
FIG. 8 is a side view of the ceiling-suspended storage system of FIG.7.

Referring to FIGS. 7 and 8, isometric and side views, respectively, of a third embodiment of a ceiling-suspended storage system are shown. Storage system 700 of FIGS. 7 and 8 is similar to storage system 500 of FIGS. 5 and 6 in that both include several different compartmentalized storage spaces and various cross member segments. However, storage system 700 is designed for ease of manufacturability and for occupying a minimal amount of space when being shipped as will be described in more detail below.

Storage system 700 includes brackets 702 and 704 that are coupled to ceiling 710. As can be seen from FIGS. 7–8, each bracket has two major sections: one being L-shaped and one having a zig-zag shape. For example, referring to bracket 702, the first major section is L-shaped and is comprised of segments 702*a–d* (all being horizontal segments with the exception of segment 702*a* which is vertical), and the second major section is zig-zag shaped and is comprised of cross-member segments 702*e–j*. Corresponding sections and segments exist for bracket 704 as shown. When assembling the brackets, the first section is coupled to the second section at points 706–708 by any type of fastener such as nuts and bolts, rivets or spot welding—to name a few. Further, because the brackets 702 and 704 are comprised of only two sections, each section can be easily and efficiently configured from one piece of metal (or any other type of suitable material that can be bent or shaped) that is bent once (in the case of the L-shaped section) or several times (in the case of the zig-zag shaped section). Also, when storing or shipping several unassembled brackets, each of the first sections can be nested within each other while each of the second sections can be nested within each other. Accordingly, the unassembled brackets may be efficiently shipped and stored because of their ability to be nested within each thereby minimizing the amount of required space.

With the inclusion of cross member segments 702*e–j*, storage system 700 includes similar compartmentalized storage areas as was shown and described for storage system 500. Accordingly, storage areas such as area 711 is much better suited to store elongated items having a circular cross section, such as elongated item 712, because such circular items will not roll when nested between segments 702*g* and 702*h*. Moreover, storage area 714 is well suited to store elongated items having a rectangular, or square, cross section, such as elongated item 716 due to horizontal segment 702*d*.

While several embodiments of the present invention are described, it is contemplated that various modifications may be made thereto without departing from the spirit and scope of the present invention. Accordingly, it is intended that the embodiments described be considered only as illustrative of the invention and that the scope of the invention be determined by the claims hereinafter provided.

What is claimed is:

1. A system for storing elongated objects, comprising:

a first bracket adapted to be suspended from a ceiling;

a second bracket adapted to be suspended from said ceiling, said first and second brackets being separated by a first distance;

wherein each one of said first and second brackets consists of only two sections:

a first section having an L-shaped configuration; and a second section having a zig-zag shaped configuration, wherein said first section is fastened to said second section at a plurality of locations thereby forming a bracket having a plurality of cross member segments; and wherein the system is capable of storing elongated objects that are at least a length of said first distance.

2. The system of claim 1 further including a third bracket being suspended from said ceiling, said third bracket being longitudinally positioned between said first and second brackets such that a distance between said first and third brackets is a second distance and a distance between said second and third brackets is a third distance, and wherein said system is capable of storing elongated objects that are at least a length of said second distance and that are at least a length of said third distance.

3. The system of claim 2 wherein said second distance and said third distance is less than said first distance.

4. The system of claim 2 wherein said second distance is less than said third distance.

5. The system of claim 1 wherein each of said brackets includes at least one cross member segment.

6. The system of claim 1 wherein each of said first sections of said first and second brackets comprises:

a first segment having first and second ends, said first end of said first segment adapted to be coupled to said ceiling;

a second segment having first and second ends, said first end of said second segment being coupled to said second end of said first segment and said second end of said second segment being coupled to said second section.

7. The system of claim 6 wherein each of said second sections of said first and second brackets comprises:

a first segment having first and second ends, said first end of said first segment adapted to be coupled to said ceiling and to said first end of said first segment of said first section, said second end of said first segment adapted to be coupled to said first section; and at least one second segment having a first and second ends, said first end adapted to be coupled to said ceiling, said second end adapted to be coupled to said first section.

8. The system of claim 7 wherein said first and second segments of said second section form the plurality of cross member segments thereby providing a plurality of compartmentalized storage areas.

9. A system for storing elongated objects, comprising:

a first bracket adapted to be suspended from a ceiling;

a second bracket adapted to be suspended from said ceiling, said first and second brackets being separated by a first distance;

wherein each one of said first and second brackets consists of only two sections:

a first section having an L-shaped configuration; and a second section having a zig-zag shaped configuration, wherein said first section is fastened to said second section at a plurality of locations;

wherein the system is capable of storing elongated objects that are at least a length of said first distance; and wherein each of said first and second brackets includes a plurality of segments that form a plurality of pockets of storage space for use in storing said elongated objects having different shapes.

10. The system of claim 9 wherein at least one of said plurality of pockets of storage space includes at least one non-linear segment.

11. The system of claim 9 wherein at least one of said plurality of pockets of storage space includes at least one cross member segment.

12. A method for storing elongated objects, the method comprising the steps of:

suspending a first bracket from a ceiling;

suspending a second bracket from said ceiling, said first and second brackets being separated by a first distance;

wherein each one of said first and second brackets consists of only two sections:

a first section having an L-shaped configuration; and a second section having a zig-zag shaped configuration, wherein said first section is fastened to said second section at a plurality of locations;

wherein the system is capable of storing elongated objects that are at least a length of said first distance; and wherein each of said first and second brackets are configured to include a plurality of segments that form a plurality of pockets of storage space for use in storing said elongated objects having different shapes.

13. The method of claim 12 further including the step of suspending a third bracket from said ceiling, said third bracket being longitudinally positioned between said first and second brackets thereby providing for the storage of elongated objects whose length is less than said first distance.

* * * * *